US007712929B2

(12) United States Patent
Schaefer et al.

(10) Patent No.: US 7,712,929 B2
(45) Date of Patent: May 11, 2010

(54) LIGHTING DEVICE WITH COMPOSITE REFLECTOR

(75) Inventors: Gary Eugene Schaefer, Kitchener (CA); Wayne Douglas Campbell, Kitchener (CA)

(73) Assignee: Canlyte Inc., Lachine, Quebec (CA)

( * ) Notice: Subject to any disclaimer, the term of this patent is extended or adjusted under 35 U.S.C. 154(b) by 91 days.

(21) Appl. No.: 12/043,784

(22) Filed: Mar. 6, 2008

(65) Prior Publication Data

US 2008/0219008 A1 Sep. 11, 2008

Related U.S. Application Data

(60) Provisional application No. 60/893,179, filed on Mar. 6, 2007.

(51) Int. Cl.
*F21V 7/00* (2006.01)

(52) U.S. Cl. ..... 362/297; 362/346; 362/348; 362/517; 362/518

(58) Field of Classification Search ..... 362/297, 362/305, 346, 348, 499, 517, 518
See application file for complete search history.

(56) References Cited

U.S. PATENT DOCUMENTS

| | | | |
|---|---|---|---|
| 463,337 | A | 11/1891 | Porteous |
| 1,204,801 | A | 11/1916 | McArthur |
| 1,246,728 | A | 11/1917 | Downey |
| 1,247,000 | A | 11/1917 | Plaut |
| 1,633,837 | A | 6/1927 | Youtz |
| 1,701,176 | A | 2/1929 | Doane |
| 1,702,746 | A | 2/1929 | Prichard |
| 1,900,436 | A | 3/1933 | Dourgnon |
| 1,941,503 | A | 1/1934 | Villiers |
| 1,969,714 | A | 8/1934 | Burger |
| 2,166,394 | A | 7/1939 | Crossley |
| 2,198,077 | A | 4/1940 | Curtis |
| 3,055,535 | A | 9/1962 | Schneider |
| 3,251,987 | A | 5/1966 | Wince |
| 3,340,393 | A | 9/1967 | Frank et al. |
| 3,388,246 | A | 6/1968 | Bailey |
| 3,413,462 | A | 11/1968 | Spero |
| 3,448,260 | A | 6/1969 | Wince et al. |
| 3,505,515 | A | 4/1970 | Adra |
| 3,604,916 | A | 9/1971 | Adra |
| 3,679,889 | A | 7/1972 | Franck |
| 3,748,465 | A | 7/1973 | Murray et al. |
| 3,790,774 | A | 2/1974 | Miller et al. |
| 4,090,210 | A | 5/1978 | Wehling et al. |
| 4,143,413 | A | 3/1979 | Kelly |
| 4,164,010 | A | 8/1979 | Finch |
| 4,188,657 | A | 2/1980 | Reibling |
| 4,190,355 | A | 2/1980 | Avery et al. |
| 4,212,050 | A | 7/1980 | Trenkler |
| 4,229,782 | A | 10/1980 | Ruud et al. |
| 4,242,725 | A | 12/1980 | Douma et al. |

(Continued)

*Primary Examiner*—Sandra L O'Shea
*Assistant Examiner*—Meghan K Dunwiddie
(74) *Attorney, Agent, or Firm*—Middleton Reutlinger; John F. Salazar

(57) ABSTRACT

A light fixture device comprises a reflector portion having a pair of parallel longitudinal boundary regions and a pair of parallel lateral boundary regions; the reflector portion being shaped according to a longitudinal focal line, a pair of housing portions, each for engaging a corresponding lateral boundary region; at least one connector portion for coupling the housing portions together with the reflector portion.

11 Claims, 15 Drawing Sheets

U.S. PATENT DOCUMENTS 4,261,028 A 4/1981 Adam
4,261,030 A 4/1981 Hernandez
4,293,901 A 10/1981 Hernandez
4,310,876 A 1/1982 Small, Jr. et al.
4,319,313 A 3/1982 Eberhart et al.
4,333,131 A 6/1982 Hujimoto et al.
4,360,863 A 11/1982 Barnes et al.
4,390,934 A 6/1983 Willing
4,410,931 A 10/1983 DeCandia et al.
4,451,875 A 5/1984 Odie et al.
4,462,068 A 7/1984 Shadwick
4,471,411 A 9/1984 Graham et al.
4,473,873 A 9/1984 Quiogue
4,516,196 A 5/1985 Blake
4,527,224 A 7/1985 Sangiamo et al.
4,531,180 A 7/1985 Hernandez
4,559,587 A 12/1985 Quiogue et al.
4,564,888 A 1/1986 Lewin et al.
4,569,003 A 2/1986 Elmer et al.
4,587,602 A 5/1986 Dean et al.
4,590,544 A 5/1986 Decandia
4,623,956 A 11/1986 Conti
4,683,525 A 7/1987 Camm
4,731,714 A 3/1988 Kelly et al.
4,760,511 A 7/1988 Russello et al.
4,816,976 A 3/1989 Fouke et al.
4,839,781 A 6/1989 Barnes et al.
4,851,970 A 7/1989 Bronder
4,858,091 A 8/1989 Fouke
4,862,333 A 8/1989 Brasket
4,881,156 A 11/1989 Shemitz et al.
4,894,758 A 1/1990 O'Toole
4,937,718 A 6/1990 Murray
4,953,063 A 8/1990 Nino
4,994,947 A 2/1991 Fesko
5,046,818 A 9/1991 Barnes
5,051,878 A 9/1991 Ngai
5,068,769 A 11/1991 Umeda et al.
5,158,348 A 10/1992 Sakamoto et al.
5,278,745 A 1/1994 Kelly et al.
5,289,358 A 2/1994 Halemeier
5,307,254 A 4/1994 Russello et al.
5,309,341 A 5/1994 Russello et al.
5,313,379 A 5/1994 Lemons et al.
5,339,234 A 8/1994 Russello et al.
5,363,293 A 11/1994 Lasker
5,379,199 A 1/1995 Hirshenhorn et al.
5,383,102 A 1/1995 Jones
5,444,606 A 8/1995 Barnes et al.
D364,242 S 11/1995 Fiorato
5,546,292 A 8/1996 Shemitz
5,586,015 A 12/1996 Baldwin et al.
5,613,766 A 3/1997 Raouf
5,615,947 A 4/1997 Shambo et al.
5,642,934 A 7/1997 Haddad
5,647,659 A 7/1997 Mori
5,707,142 A 1/1998 Gordin
5,803,585 A 9/1998 Littman et al.
5,906,431 A 5/1999 Chianale et al.
5,938,317 A 8/1999 Thornton
5,997,156 A 12/1999 Perlo et al.
5,997,158 A 12/1999 Fischer et al.
6,010,233 A 1/2000 Mulder et al.
6,027,231 A 2/2000 Fouke
6,059,422 A 5/2000 Fischer et al.
6,200,006 B1 3/2001 Natsume et al.
6,224,246 B1 5/2001 Natsume et al.
6,234,643 B1 5/2001 Lichon, Jr.
6,238,065 B1 5/2001 Jones
6,260,981 B1 7/2001 Fiene
6,280,064 B1 8/2001 Sato et al.
6,290,376 B1 9/2001 Gutierrez et al.
6,494,596 B1 12/2002 Burroughs
6,523,982 B1 2/2003 Haddad
6,575,601 B1 6/2003 Sitzema, Jr. et al.
6,582,110 B1 6/2003 Negri et al.
6,698,908 B2 3/2004 Sitzema, Jr. et al.
6,703,799 B2 3/2004 Summerford et al.
6,729,752 B2 5/2004 Nakata
6,786,618 B2 9/2004 Schulz et al.
6,910,785 B2 6/2005 Sales
6,945,675 B2 9/2005 Jongewaard et al.
7,025,476 B2 4/2006 Leadford
7,063,449 B2 6/2006 Ward
7,244,050 B2 7/2007 Summerford et al.
7,296,914 B1 11/2007 Russello et al.
2002/0003707 A1 1/2002 Woodward
2004/0213011 A1 10/2004 Komarynsky
2005/0281034 A1 12/2005 Summerford et al.

LIGHTING DEVICE WITH COMPOSITE REFLECTOR

CROSS-REFERENCE TO RELATED APPLICATIONS

The entire subject matter of U.S. Provisional application Ser. No. 60/893,179 filed Mar. 6, 2007 and entitled LIGHTING DEVICE WITH COMPOSITE REFLECTOR is incorporated by reference. The applicants claim priority benefit under Title 35, United States Code, Section 119 of U.S. Provisional application Ser. No. 60/893,179 filed Mar. 6, 2007 and entitled LIGHTING DEVICE WITH COMPOSITE REFLECTOR.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

FIELD OF THE INVENTION

The present invention relates to lighting devices.

DESCRIPTION OF THE RELATED ART

Among the many types of lighting devices available on the market is the class of lighting devices known as flood lights which provide a relatively even distribution of light over a relatively wide broadcast area. Commonly, these flood lights have a relatively high profile housing in order to allow sufficient optical length between a light source and a reflector and to accommodate the relatively deep and wide dimensions of the reflector to achieve the wide distribution of light. While conventional wide area flood lights are effective for their intended task and design constraints, there are applications in which wide area light distribution is needed, but where conventional light devices dimensions are excessive compared with the space available for them. Examples of earlier art lighting devices may be found in U.S. Pat. No. 6,200,006, US 24213011A1, US22003707A1, U.S. Pat. No. 7,063,449, U.S. Pat. No. 6,786,618, U.S. Pat. No. 6,729,752, U.S. Pat. No. 6,582,110, U.S. Pat. No. 6,280,064, U.S. Pat. No. 6,224,246, U.S. Pat. No. 6,010,233, U.S. Pat. No. 4,994,947, U.S. Pat. No. 4,953,063, U.S. Pat. No. 4,190,355, U.S. Pat. No. 6,494,596, U.S. Pat. No. 6,575,601, U.S. Pat. No. 6,698,908, U.S. Pat. No. 6,910,785, U.S. Pat. No. 7,025,476, U.S. Pat. No. 4,683,525, U.S. Pat. No. 4,816,976, U.S. Pat. No. 4,839,781, U.S. Pat. No. 5,046,818 and U.S. Pat. No. 5,444,606. The entire subject matter of these references is incorporated by reference.

It would be desirable to provide a novel approach to this task.

SUMMARY OF THE INVENTION

In a first embodiment, the invention provides a light fixture device, comprising a reflector portion having a pair of parallel longitudinal boundary regions and a pair of parallel lateral boundary regions. The reflector portion is shaped according to a longitudinal focal line. A pair of housing portions is provided, each for engaging a corresponding lateral boundary region. At least one connector portion is provided for coupling the housing portions together with the reflector portion.

In some embodiments, the reflector portion is formed in an extruded profile, though alternative embodiments may be formed using other forming techniques.

In some embodiments, the reflector portion is arranged to present a plurality of aligned reflector segments, which each reflector segment is oriented relative to the longitudinal focal line, so that the aligned reflector segments may collectively form a composite reflector with a predetermined focal region. In one embodiment, each reflector segment is substantially perpendicular to a path extending between the reflector portion and the longitudinal focal line, though in other alternative embodiments the reflector segment may not be substantially perpendicular to the path.

In some embodiments, each of the end portions having a first mounting flange extending outwardly therefrom. The mounting flanges may in a common plane and similarly the longitudinal boundary regions may lie in a common plane, though other alternative configurations are also contemplated.

In some embodiments, the mounting flanges include mounting passages to receive a light cover portion, and/or one housing portion includes a central passage to receive a light source. In the latter instance, the light source may include a socket portion mounted to the corresponding end portion or another light source.

In some embodiments, each connector portion has a length according to the length of the reflector portion, with each connector portion having a pair of end regions. In this case, the housing portion may thus include a pair of fastener passages, each to receive a corresponding end region or a fastener for anchoring the end region therewith. Each end region may include a threaded inner passage, the fastener including a threaded fastener threadably engaged with the threaded inner passage. The connector portion may desirably be integrally formed with the reflector portion in an extruded profile or be formed separately therefrom.

In an alternative embodiment, there is provided a light fixture device, comprising a reflector portion having a pair of parallel longitudinal boundary regions and a pair of parallel lateral boundary regions; the reflector portion being shaped according to a longitudinal focal line, a pair of housing portions, each for engaging a corresponding lateral boundary region; at least a pair of connector portions extending along the reflector portion, each connector portion having a mounting location, each housing portion having a pair of mounting passages, each mounting passage lying adjacent a corresponding mounting location, the connector portion and/or a fastener extending through each corresponding mounting passage to join the reflector portion with the housing portions.

In still another alternative embodiment, there is provided a light fixture device, comprising reflector means having a pair of parallel longitudinal boundary regions and a pair of parallel lateral boundary regions; the reflector means being shaped according to a longitudinal focal line, a pair of housing means, each for engaging a corresponding lateral boundary region; at least a pair of connector means extending along the reflector means, each connector means having a mounting location, each housing means having a pair of mounting passages, each mounting passage lying adjacent a corresponding mounting location, the connector means and/or a fastener means extending through each corresponding mounting passage to join the reflector means with each of the housing means.

In yet another alternative embodiment, there is provided a method of forming a lighting fixture device, comprising:

modeling an elongate reflector portion with a first surface region according to a predetermined focal line to have a series of reflector segments, each aligned with the focal line according to a particular operative orientation for a finished lighting fixture device and to have a pair of opposed longitudinal boundary regions and a pair of opposed lateral boundary regions, to form a modeled reflector portion;

forming a profile blank according to the modeled reflector portion;

providing a finished reflector portion according to the modeled reflector portion;

providing a pair of end housing portions, each for engaging a corresponding end region; and, providing at least one connector portion for coupling the reflector portion with the housing portions.

In some embodiments the modeling step may further comprise integrating the connector portions in the modeled reflector portion. The modeling step may comprise modeling the elongate reflector portion to include a second surface region and to locate the connecting portions thereon.

In yet another alternative embodiment, there is provided a method of forming a lighting fixture device, comprising:

a step for modeling an elongate reflector portion with a first surface region according to a predetermined focal line to have a series of reflector segments, each aligned with the focal line according to a particular operative orientation for a finished lighting fixture device to have a pair of opposed longitudinal boundary regions and a pair of opposed lateral boundary regions, to form a modeled reflector portion, and to have a plurality of connector portions extending along the elongate reflector portion to provide a corresponding pair of mounting locations adjacent a corresponding opposed lateral boundary region;

a step for forming a profile blank according to the modeled reflector portion;

a step for providing a finished reflector portion according to the modeled reflector portion;

a step for providing a pair of end housing portions, each for engaging a corresponding end region; and, a step for joining each housing portion with a pair of connector portion at the corresponding mounting locations.

In yet another alternative embodiment there is provided a method of forming a lighting fixture device, comprising:

establishing a primary reflector profile according to a predetermined focal line;

establishing a series of intermediate reflector profiles which are concentric with the primary reflector profile to form a reflector profile grid;

tracing a path across the reflector profile grid according to a desired reflector shape;

selecting a plurality of reflector segments on the primary and/or intermediate reflector profiles which approximate the path to form a modeled reflector portion; and, shaping a reflector according to the modeled reflector portion.

In yet another alternative embodiment, there is provided a method of forming a far field lighting fixture, comprising the steps of:

establishing a focal point; providing a concave primary reference path positioned relative to the focal point;

configuring the reference path and the position of the focal point to form a theoretical reflector profile for a far field lighting fixture with a light source to be located in an offset position between the focal point and the reference path;

providing a plurality of secondary reference paths which are concentric with the primary reference path and scaled about the focal point;

providing a plurality of radial lines extending from the focal point, each radial line meeting each primary and secondary reference path to form a plurality of path segments, each between adjacent radial lines and a plurality of line segments, each between adjacent path segments;

forming a modeled reflector profile for a far field lighting fixture by forming a chain of adjacent groups of one or more path segments, joined by groups of one or more line segments;

forming a far field light reflector based on the modeled reflector profile to provide a plurality of reflector path segments coextensive with the modeled path segments and a plurality of reflector line segments coextensive with the modeled line segments;

locating the far field light reflector in a housing structure, the housing structure and/or the far field light reflector providing an outer periphery;

locating the light source in the offset position beside the focal point and between the focal point and the far field light reflector; and, configuring the light source, the focal point and the far field reflector to confine the incident light emanating surfaces of the light source to land on the reflector path segments, with the light source so positioned that no light is incident on the reflector line segments, and with each reflector path segment providing an angle of reflectance which is sufficient for substantially all light reflected from the far field light reflector to pass beyond the outer periphery without being incident thereon.

In yet another alternative embodiment, there is provided a comprising one or more housing portions, a concave far field light reflector portion coupled with the housing portions, the housing portions and/or the far field light reflector defining an inner region and cooperating to form an outer fixture periphery, a lamp with a light emanating surface defining a light source boundary, the far field light reflector portion having a reference point located within the inner region, the lamp being arranged so that the light source boundary is in an offset position between the reference point and the reflector portion, the reflector portion including a plurality of reflector segments, each to receive incident light from the light source boundary, a plurality of radial segments, each separating a pair of neighboring reflector segments, each radial segment being co-linear with a radial path extending from the reference point, each radial segment facing away from the light source boundary, each reflector segment portion being positioned relative to a focal point to receive incident light from the light source boundary, each reflector segment being opposite a corresponding region on the outer boundary, each reflector segment to emit reflected light at an angle of reflectance sufficient to direct the reflected light past the outer periphery without being incident thereon.

In some embodiments, the reference point and the focal point are coincident. In other embodiments, the focal point is not coincident with the reference point, but may be, for instance, located between the reference point and the reflective portion, or beyond the reference point and on the reflecting side of the reflective portion.

In yet another alternative embodiment, there is provided a method of forming a far field lighting fixture, comprising the steps of:

establishing a focal point;

providing a concave primary reference path positioned relative to the focal point;

configuring the reference path and the position of the focal point to form a theoretical reflector profile for a far field lighting fixture with a light source to be located in an offset position between the focal point and the reference path;

providing a plurality of secondary reference paths which are concentric with the primary reference path and scaled about the focal point;

providing a plurality of radial lines extending from the focal point, each radial line meeting each primary and secondary reference path to form a plurality of path segments, each between adjacent radial lines, and to form a plurality of line segments, each between adjacent path segments;

forming a modeled reflector profile for a far field lighting fixture by forming a chain of adjacent groups of one or more path segments, joined by groups of one or more line segments;

forming a far field light reflector based on the modeled reflector profile to provide a plurality of reflector path segments coextensive with the modeled path segments and a plurality of reflector line segments coextensive with the modeled line segments;

locating the far field light reflector in a housing structure, the housing structure and/or the far field light reflector providing an outer periphery;

locating the light source in the offset position beside the focal point and between the focal point and the far field light reflector; and, configuring the light source, the focal point and/or the far field reflector to confine the incident light emanating surfaces of the light source to land on the reflector path segments, with the light source so positioned to minimize incident light from the light source on the reflector line segments, and with each reflector path segment providing an angle of reflectance which is sufficient for substantially all light reflected from the far field light reflector to pass beyond the outer periphery without being incident thereon.

In still another alternative embodiment, there is provided a method of forming a reflector portion for a far field lighting fixture, comprising the steps of:

establishing a focal point;

providing a concave primary reference path positioned relative to the focal point;

configuring the reference path and the position of the focal point to form a theoretical reflector profile for a far field lighting fixture with a light source to be located in an offset position between the focal point and the reference path;

providing a plurality of secondary reference paths which are concentric with the primary reference path and scaled about the focal point;

providing a plurality of radial lines extending from the focal point, each radial line meeting each primary and secondary reference path to form a plurality of path segments, each between adjacent radial lines, and to form a plurality of line segments, each between adjacent path segments;

forming a modeled reflector profile for a far field lighting fixture by forming a chain of adjacent groups of one or more path segments, joined by groups of one or more line segments; and forming a far field light reflector based on the modeled reflector profile to provide a plurality of reflector path segments coextensive with the modeled path segments and a plurality of reflector line segments coextensive with the modeled line segments; and, locating the far field light reflector in a housing structure, the housing structure and/or the far field light reflector providing an outer periphery.

In yet another alternative embodiment, there is provided a method of forming a far field lighting fixture, comprising the steps of:

establishing a focal point;

establishing a reference point;

providing a concave primary reference path positioned relative to the focal point;

configuring the reference path and the position of the focal point to form a theoretical reflector profile for a far field lighting fixture with a light source to be located in an offset position between the reference point and the reference path;

providing a plurality of secondary reference paths which are concentric with the primary reference path and scaled about the focal point;

providing a plurality of radial lines extending from the reference point, each radial line meeting each primary and secondary reference path to form a plurality of path segments, each between adjacent radial lines, and to form a plurality of line segments, each between adjacent path segments;

forming a modeled reflector profile for a far field lighting fixture by forming a chain of adjacent groups of one or more path segments, joined by groups of one or more line segments;

forming a far field light reflector based on the modeled reflector profile to provide a plurality of reflector path segments coextensive with the modeled path segments and a plurality of reflector line segments coextensive with the modeled line segments;

locating the far field light reflector in a housing structure, the housing structure and/or the far field light reflector providing an outer periphery;

locating the light source in the offset position beside the reference point and between the reference point and the far field light reflector; and, configuring the light source, the focal point, the reference point and/or the far field reflector to confine the incident light emanating surfaces of the light source to land on the reflector path segments, with the light source so positioned to minimize incident light from the light source on the reflector line segments, and with each reflector path segment providing an angle of reflectance which is sufficient for substantially all light reflected from the far field light reflector to pass beyond the outer periphery without being incident thereon.

In some embodiments, the light source boundary is in the shape of an elongate cylinder with an elongate axis, the reflector segments being planar and parallel to the elongate axis. Each of the reflector segments is coextensive with one of a corresponding plurality of modeled curvilinear reference paths scaled about the focal point. Each of the reflector segments is coextensive with one of a corresponding plurality of modeled parabolic reference paths scaled about the focal point.

In some embodiments, the far field reflector portion is formed from an extruded, or molded section or formed using other techniques. The reflector portion may, for instance, include a pair of lateral sections symmetrically extending outwardly from the focal point, or include a single later section asymmetrically arranged relative to the focal point.

BRIEF DESCRIPTION OF THE DRAWINGS

Several preferred embodiments of the present invention will be provided, by way of examples only, with reference to the appended drawings, wherein.

DESCRIPTION OF THE PREFERRED EMBODIMENTS

Figure 1:
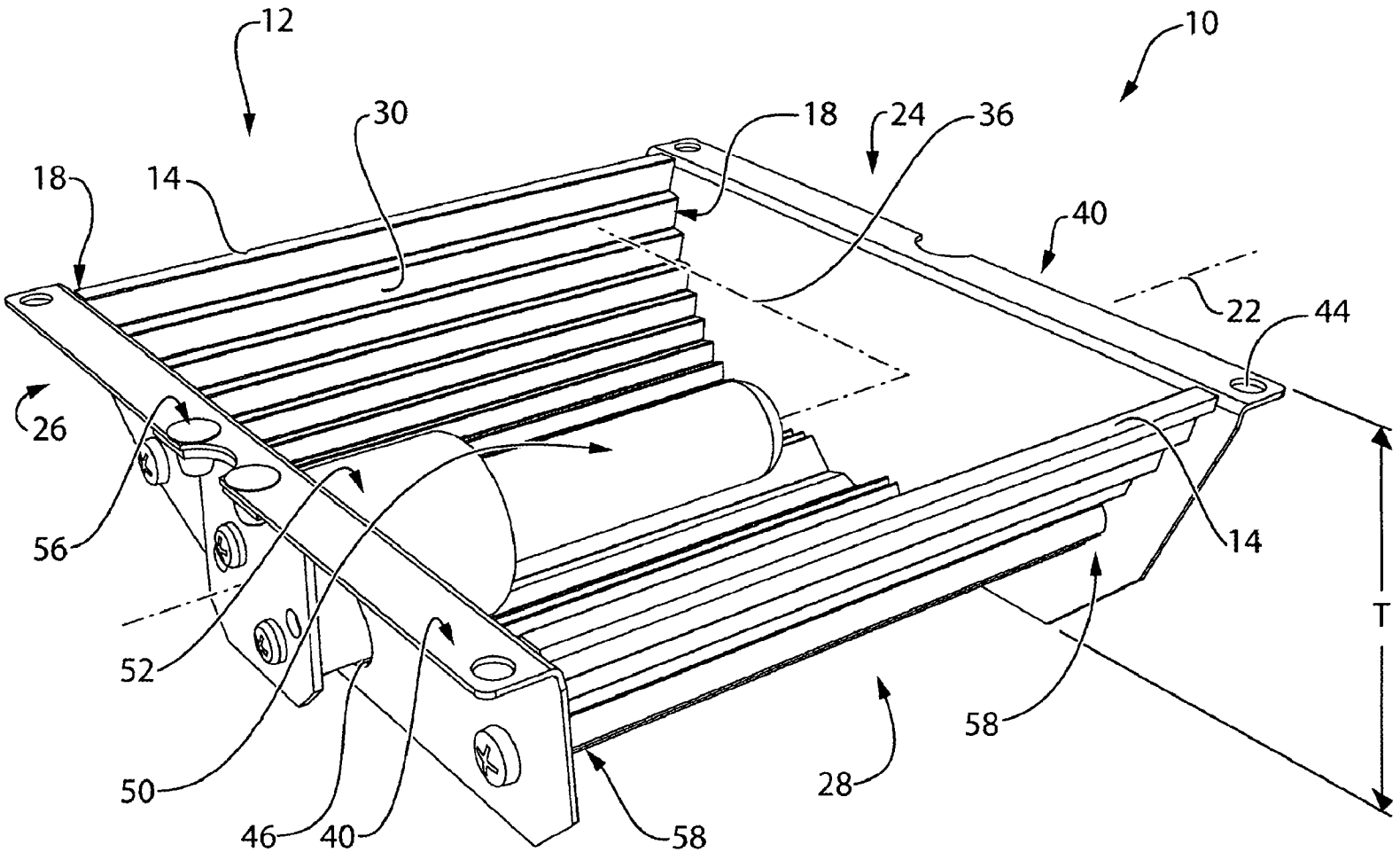
FIG. 1 is a perspective view of a lighting device.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention. However, other alternative mechanical configurations are possible which are considered to be within the teachings of the instant disclosure. Furthermore, unless otherwise indicated, the term "or" is to be considered inclusive.

Referring to the figures, there is provided a light fixture device 10 having a reflector portion 12 with a pair of parallel longitudinal boundary regions 14 and a pair of parallel lateral boundary regions 18. As will be described, the reflector portion 12 is shaped according to a longitudinal focal line 22. In this instance, the longitudinal boundary regions 14 lie in the common plane.

The light fixture 10 includes a pair of housing portions 24, 26, each for engaging a corresponding lateral boundary region 18. At least one, in this case a pair of connector portions shown at 28 is also provided on an opposed second surface region for coupling the housing portions 24, 26 together with the reflector portion 12. The reflector portion 12, in this case, is formed in an extruded profile, together with the connector portions 28, as will be described.

The reflector portion 12 is further arranged to present a plurality of aligned reflector segments 30, each of which is oriented relative to the longitudinal focal line 22 and collectively forming a composite reflector with a predetermined focal region. Each reflector segment 30, in this case, may be substantially perpendicular to a radial path 36 extending between the reflector portion 12 and the longitudinal focal line 22, or may have a different orientation for a desired optical effect.

In this case, the arrangement of the reflector segments 30, in their collective perpendicular orientation relative to the focal line 22, is particularly useful for the lighting device 10 to operate as a low profile wide distribution light. The term "low profile" is intended to refer to the thickness dimension "T" which is relatively shallow for the wide light distribution of the resulting light fixture device 10, when compared to a conventional lighting device providing a similarly wide light distribution. The use of a composite reflector in this case (and in one example made of a number of sectors of a multiple of reflector profiles as will be described) can be compared to the use of a multiple of lens components used in a Fresnel lens, but in this case applied to a reflector.

Each housing portion 24, 26 has a first mounting flange 40 extending outwardly therefrom. In this example, the first mounting flanges 40 lie in a common plane to be installed in an exterior light casing 42, as shown in FIG. 1*a*. If desired, the first mounting flanges 40 may alternatively be oriented in different planes according to the intended use of the lighting device 10.

The first mounting flanges 40 include mounting passages 44 to secure the housing portions 24, 26 to the external casing 42 by way of fasteners 45. In addition, the housing portion 26 includes a central passage 46 to receive a light source 50.

Figure 3:
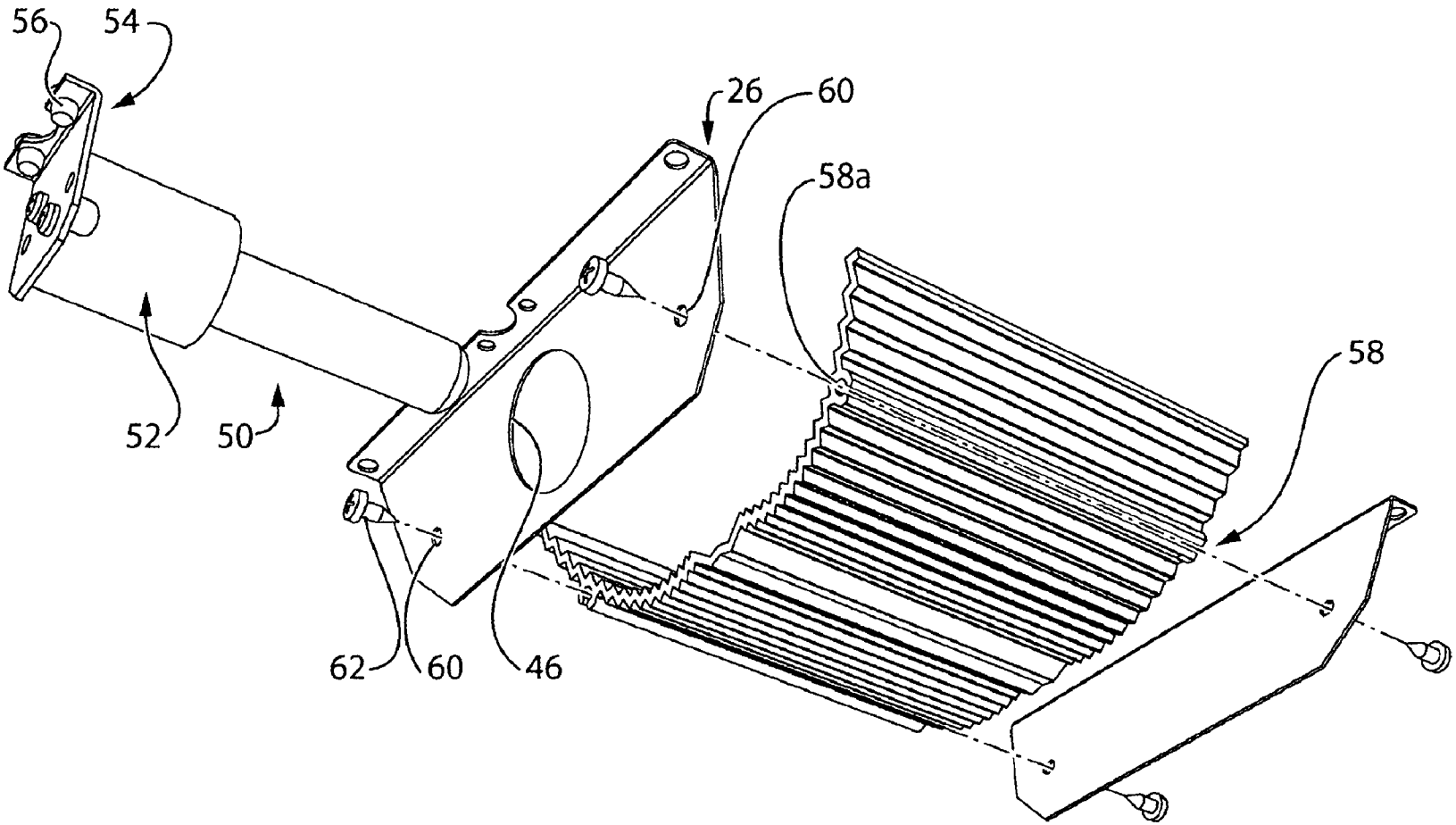

The light source 50 includes a socket portion 52 mounted to the housing portion 26 by way of fasteners 56. The socket portion 52 includes a second mounting flange 54 (FIG. 3), which is coupled with a corresponding first mounting flange 40, by way of fasteners 56.

Each connector portion 28 has a length according to the length of the reflector portion 12 and is provided with a pair of end regions 58.

Each housing portion 24, 26 includes a pair of fastener passages 60 (FIG. 3), each to receive a corresponding end region 58 or a fastener 62 for anchoring the end region 58 therewith. In this case, each end region 58 includes an inner passage 58*a* (see FIGS. 3 and 4) and the fastener 62, in this case, is threadably engaged with the inner passage 58*a*. Alternatively, the end region 58 may be arranged to extend through the fastener passages 60 (not shown) if desired. Alternatively, a pair of flanges (not shown) may be formed on the housing portion to engage the corresponding end region 58.

Figure 4:
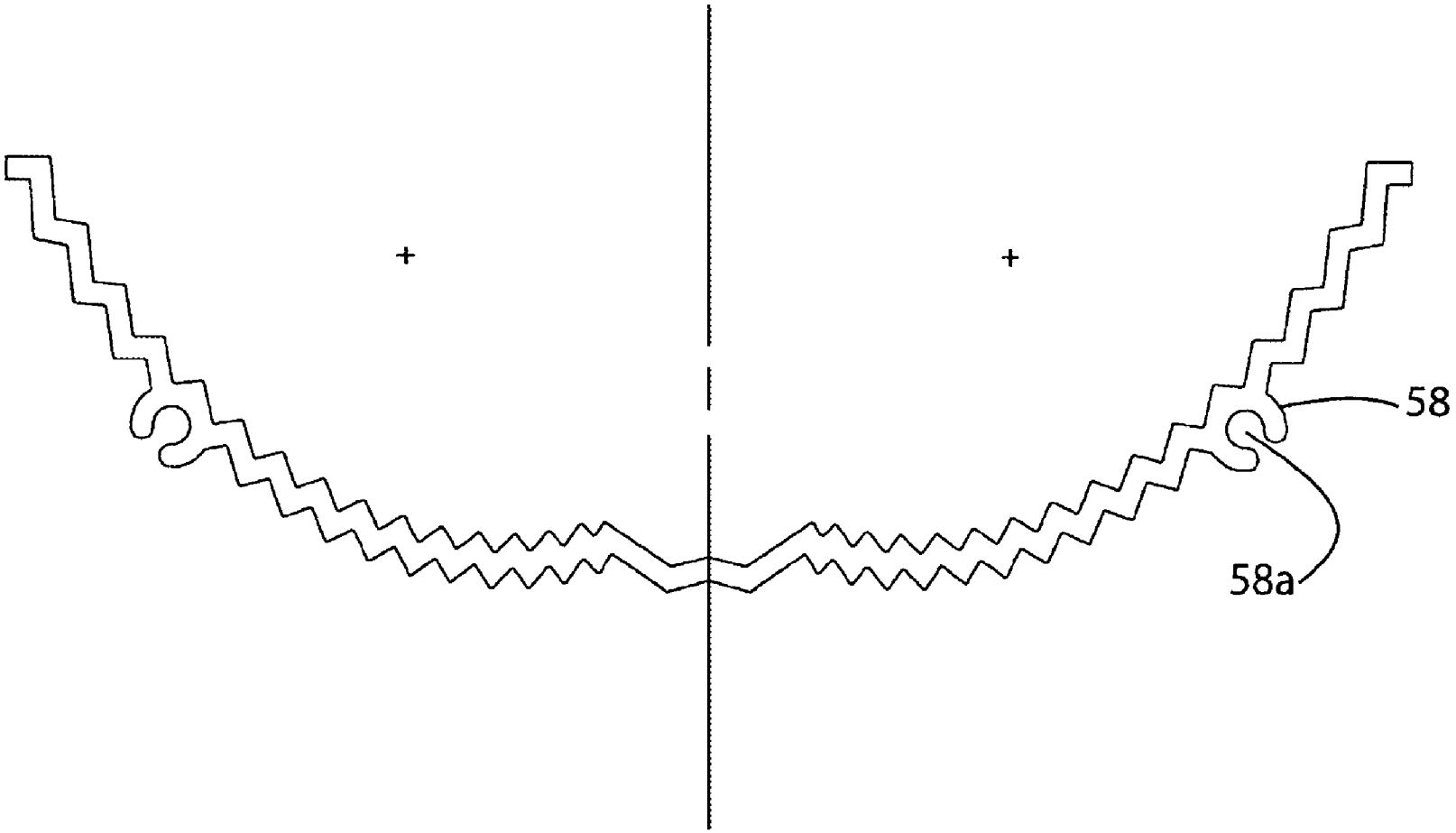
FIG. 4 is a side view of one portion of the device of FIG. 1.
Figure 5:
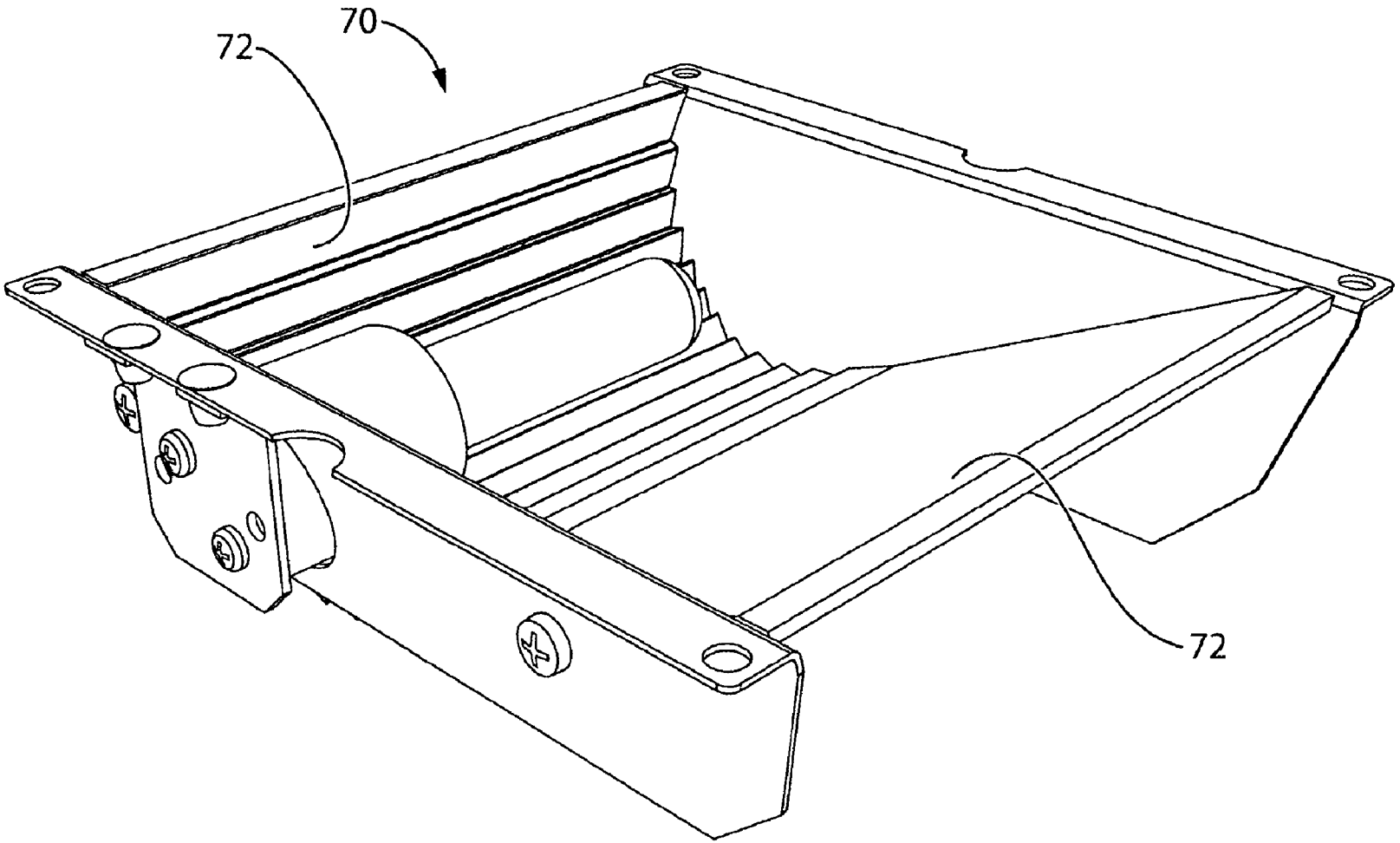
FIGS. 5 to 7 are perspective or assembly views of another lighting device.
Figure 6:
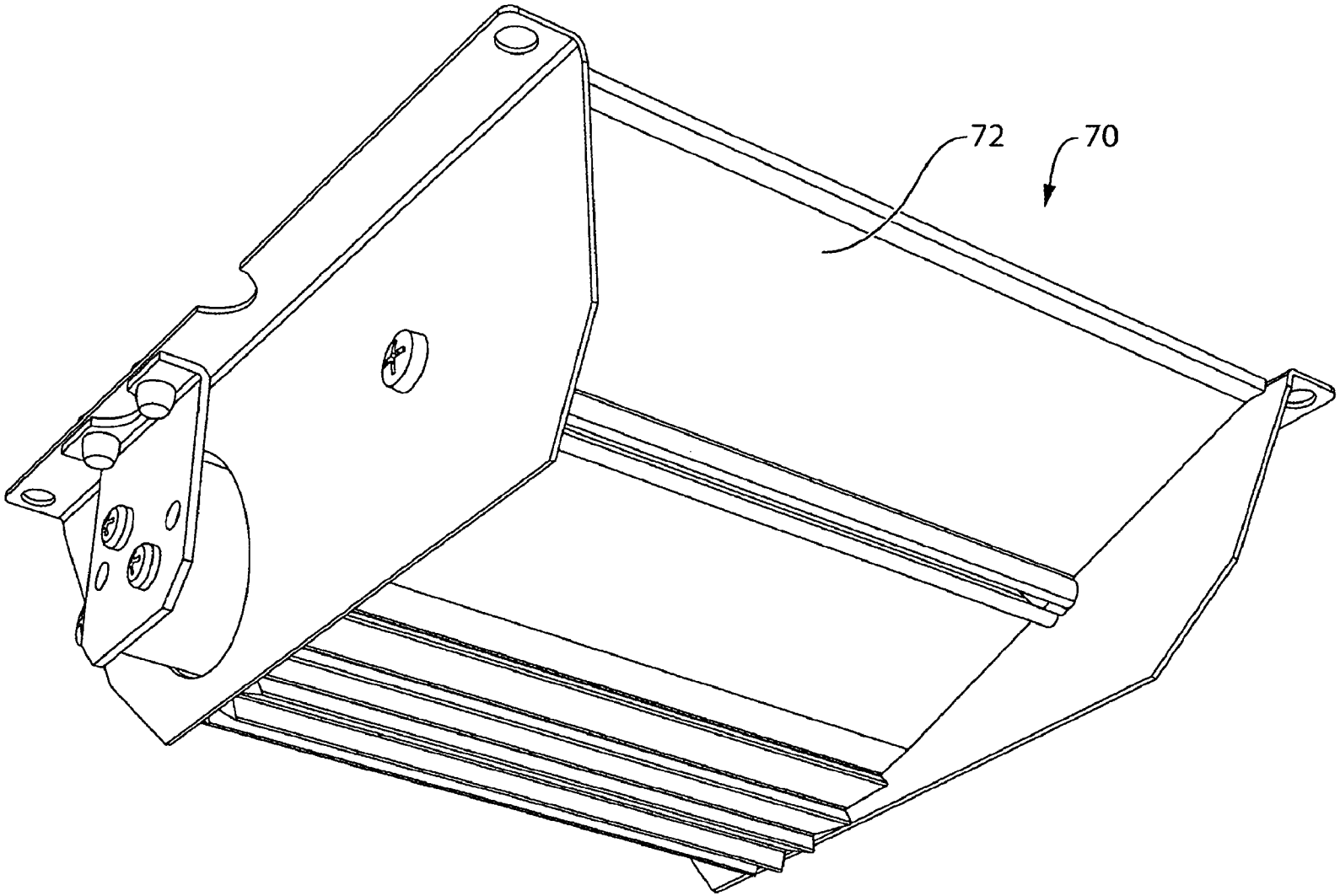
Figure 7:
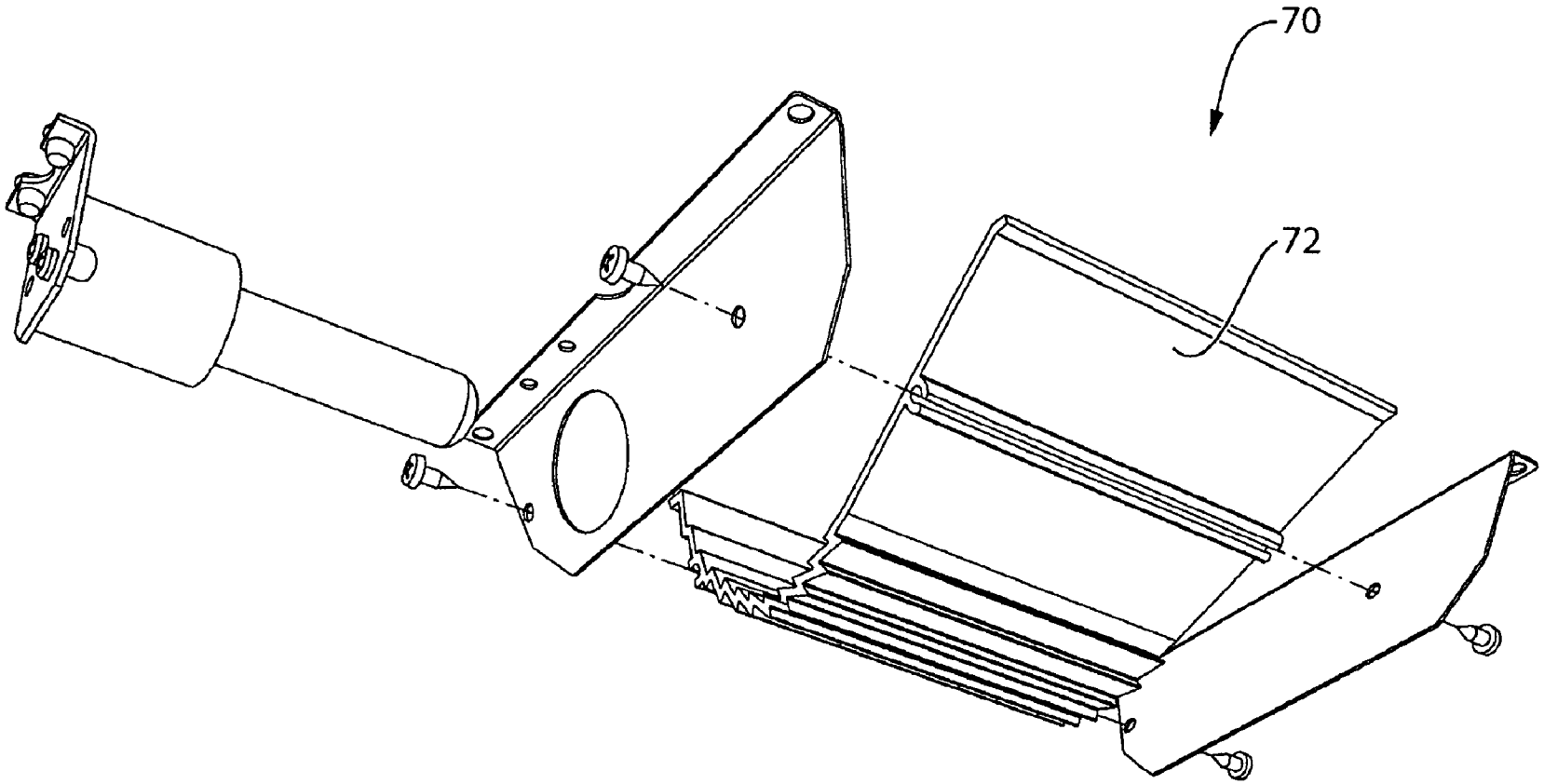
Figure 8:
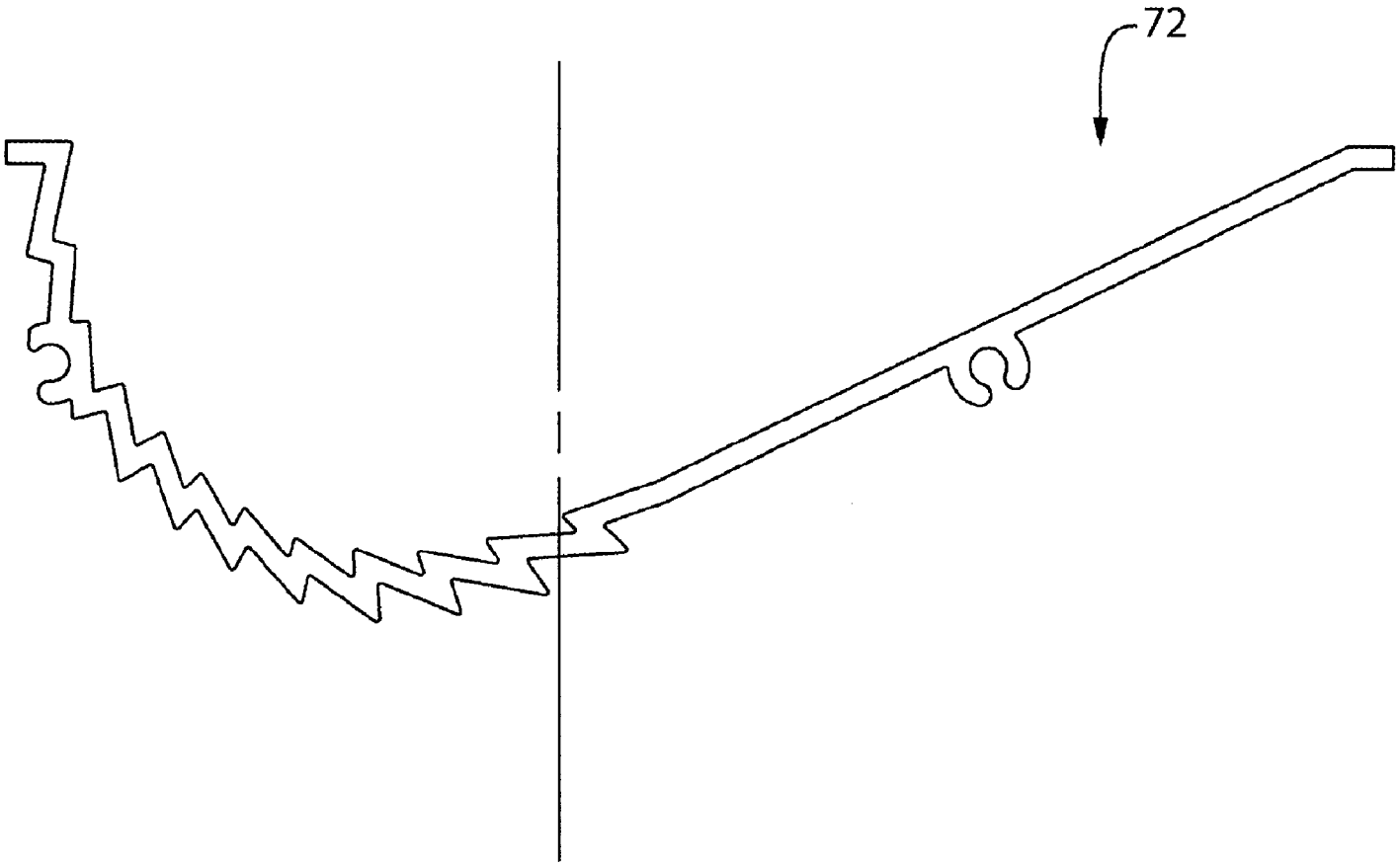
FIG. 8 is a side view of one portion of the device of FIG. 5.

The reflector portion 12 can be seen in FIG. 4 to be symmetrical about a central reference plane. An alternative light fixture device 70 is shown at 70 in FIGS. 5 to 8 with a reflector portion 72 which is asymmetrical about a central reference plane.

Figure 9:
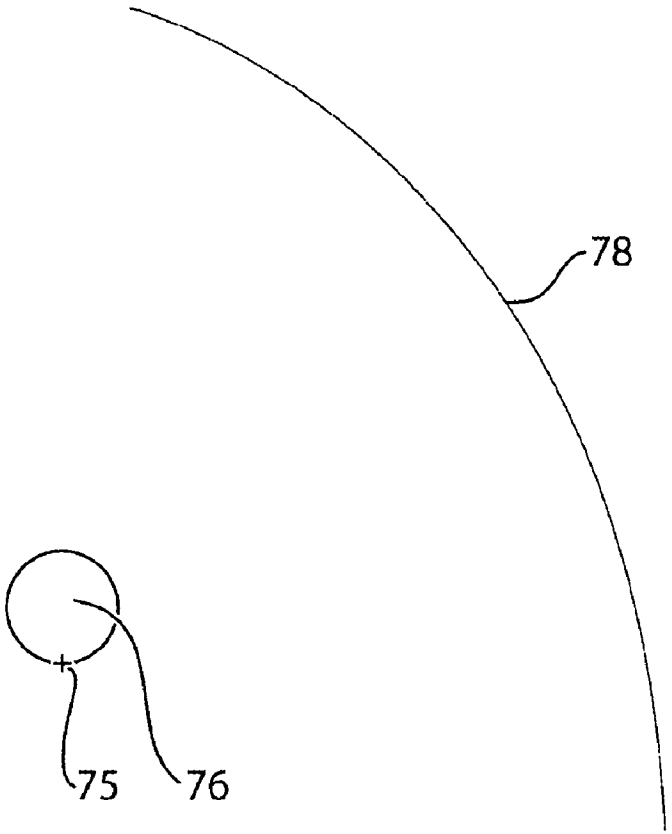
Figure 12:
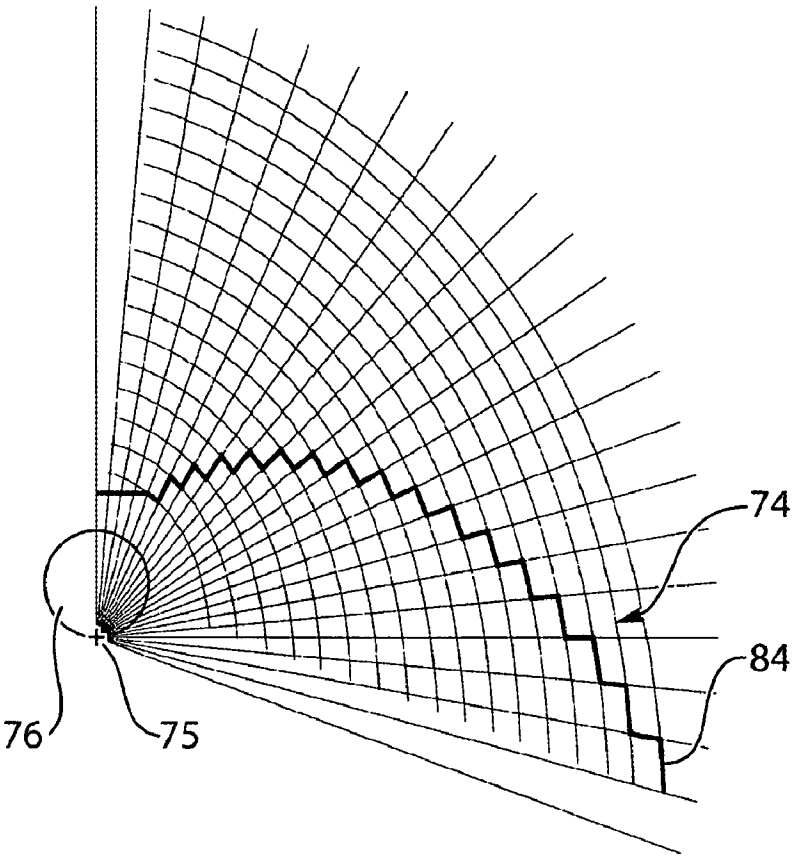

Referring to FIGS. 9 to 13, the lighting device 10 may be assembled as follows. First, a modeled reflector portion 74 as shown in FIG. 12 is prepared, by establishing a reference point 75 immediately adjacent to and/or below a focal region 76 (to be occupied by a light source) as shown in FIG. 9 and establishing the desired optical characteristics of the resulting lighting device. For instance, the lighting device may be intended as a "wide distribution" device, meaning that the light issued from the focal region and above the reference point 75 as viewed in FIG. 9 is to be broadcast over a wide area. The optical characteristics may include concentrating light in opposed outer sectors of the wide broadcast area with a shadow in a central region thereof. Alternatively, the optical characteristics may include broadcasting the light evenly over the wide broadcast area.

Figure 10:
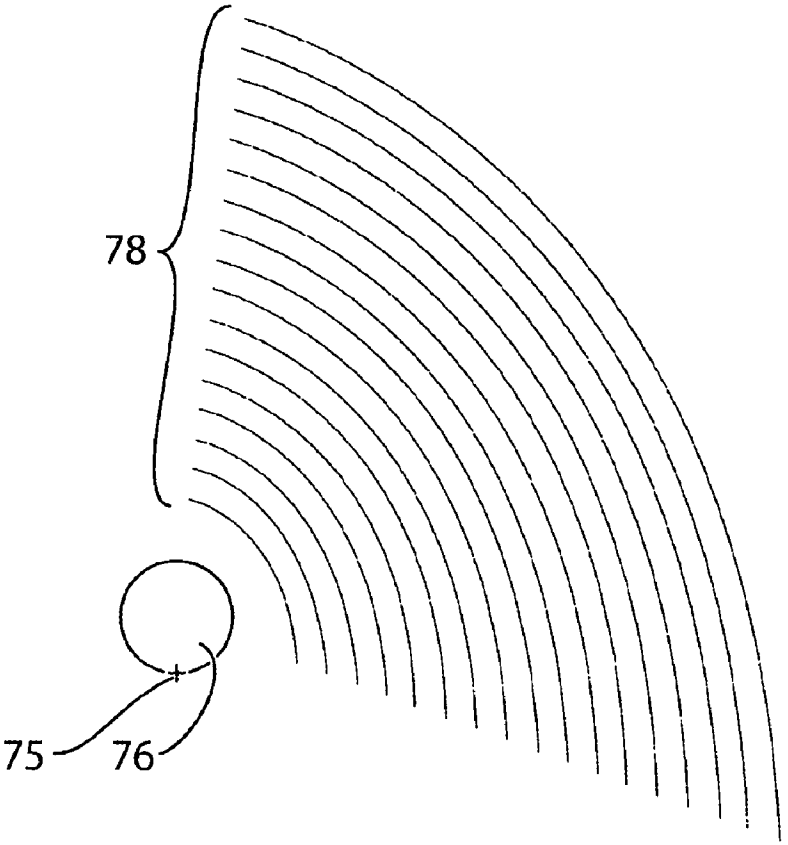
FIGS. 9 to 13 are schematic views relating to a method of forming a lighting device.

A number of reflector profile lines 78 scaled about the centre of the focal region 76 are then established in a prescribed relationship to one another as shown in FIG. 10. The reflector profile lines 78 may be continuous or discontinuous, concentric or nonconcentric, or in some other orientation, again dependent on the desired optical characteristics.

Figure 11:
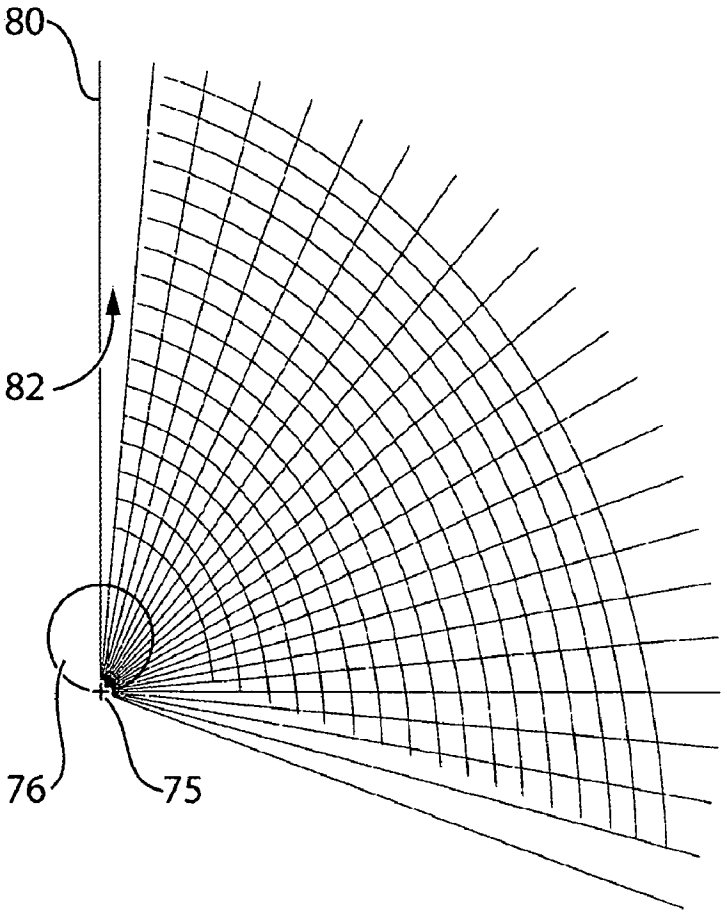

Then a number of radius lines 80 may be established as shown in FIG. 11, extending radially outwardly from the reference point 75. The radius lines 80 may be evenly spaced, for example at an angular spacing of between 5 and 15 degrees, such as 5 degrees, or irregularly spaced, again depending on the desired optical characteristics.

Figure 13:
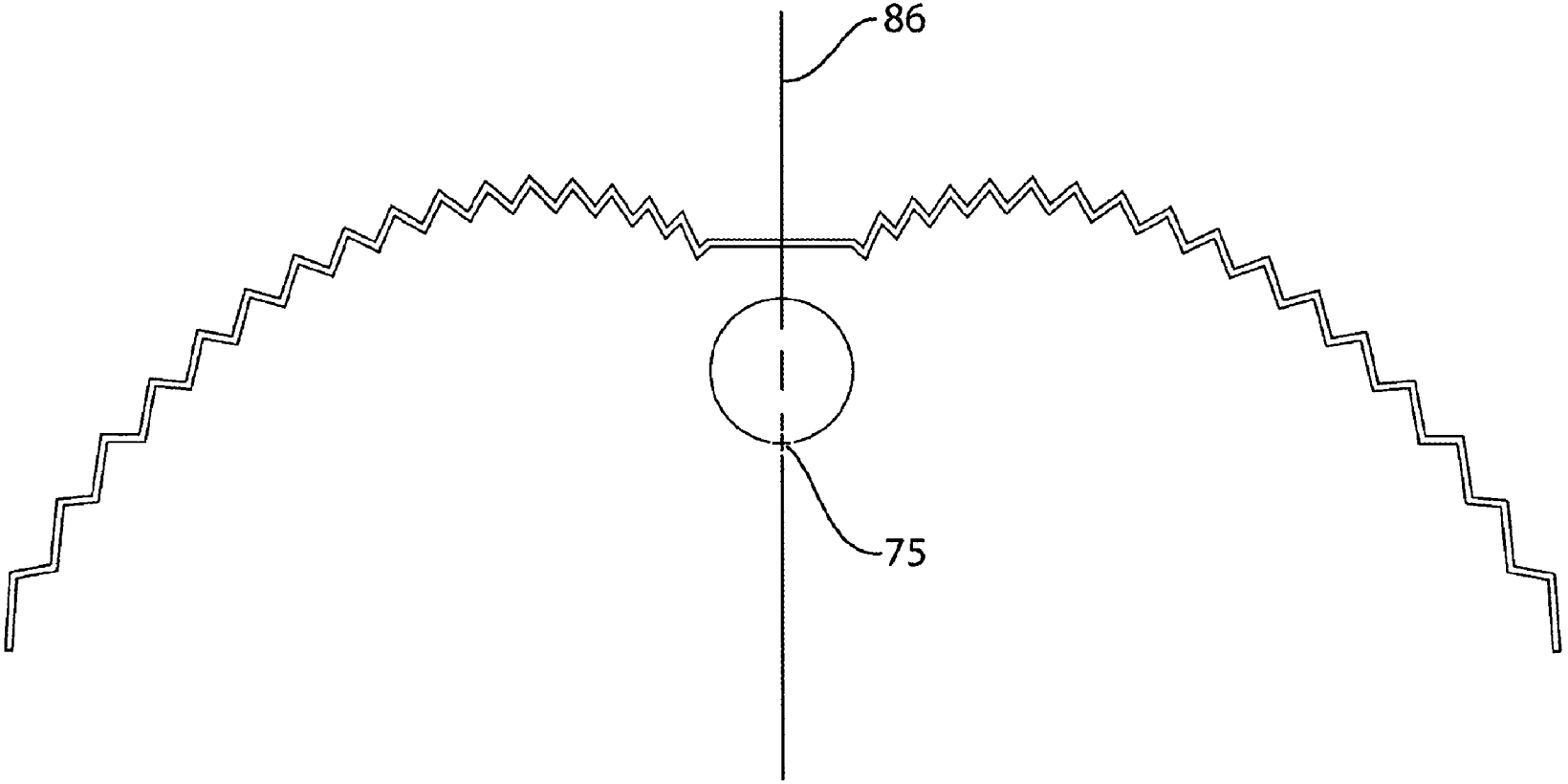

Next, for each zone 82 between an adjacent pair of radius lines 80, a sector of one reflector profile line 78 is selected, such as that identified at 84 as shown in FIG. 12. Thus, if there are twenty such zones 82 between adjacent pairs of radius lines 80, then twenty sectors 84 are selected. The modeled reflector portion 74 is then formed by joining the sectors 84 together. In other words, the modeled reflector portion 74 provides the shape of the optically active design surface of the reflector portion 12. The design surface may then be arranged to provide a mirrored opposed design surface to be used for a reflector on a side opposite a plate traveling through the reference point 75, as shown in FIG. 13.

Next, a mold is formed to provide a reflector portion with the optically active design surface. The mold may be of the type to produce an extrusion, as in the present example, or an injection, blow or other molding technique. With the mold formed, reflector portions may thus be formed and finished, such as polished or buffed, painted, plated, or treated with a metalized surface finish as an alternate to polish or buffed, among others methods, in a suitable manner provide a desired optical effect, for example with a clean mirror finish, a diffuse matte finish or the like.

The so-formed reflector portion 12 may then be assembled with the housing portions 24, 26 by installing fasteners 62 in the integrally formed connector portions 28 to form an assembled lighting device 10. The same method may be employed to form the light fixture device 70 except that the mirrored opposed design surface (about central plane 86) is not required.

Thus, in the example of the method explained above, the profile lines 78 are scaled about a centre point of the focal region 76 while the radial lines emanate from the reference point 75. This means that the curves and the radial lines are referenced to two different locations. However, the curves and the radial lines may, if desired, be referenced to a common point, namely the reference point which in this case is a focal point, as may be seen in FIGS. 14 and 15. In this case, the method of FIGS. 9 to 12 is practiced to form a reflector for a lighting fixture, such as a far field lighting fixture, by first establishing the reference point 75 as the focal point. A concave primary reference path 78 is then provided or established and which is positioned relative to the focal point 75. The reference path 78 and the position of the focal point 75 are then configured to form a theoretical reflector profile for a far field lighting fixture with a light source to be located in an offset position between the focal point and the reference path. Thus, the focal point may be coincident with the reference point or may not be coincident with the reference point. The focal point may be located between the reference point and the reflective portion, or may be beyond the reference point and on the reflecting side of the reflective portion.

Next, a plurality of secondary reference paths are provided or established which are concentric with the primary reference path and scaled about the focal point 75. A plurality of radial lines 80 are then formed which extend from the focal point 75 with each radial line 80 meeting each primary and secondary reference path 78. The intersections of the radial lines and the primary and second reference paths thus form a plurality of path segments 84 between adjacent radial lines and a plurality of line segments 88 between adjacent path segments 84.

A modeled reflector profile 74 may then be formed for a far field lighting fixture by joining, in a chain, adjacent groups of one or more path segments with groups of one or more line segments. The profile of the reflector profile 74 is thus shown by trace A which has a horizontal dimension from the focal point measured at Xa and a vertical dimension measured from the lowermost and uppermost edges of the plot by Ya. Alternative profiles, such as shown by path B, may be provided with different dimensions Xb, Yb by joining different combinations of path and line segments. Both profiles should provide similar far field lighting optics since both are based on the same parabolic reference paths 78, the same radial lines 80 and the same focal point 75.

Figure 16:
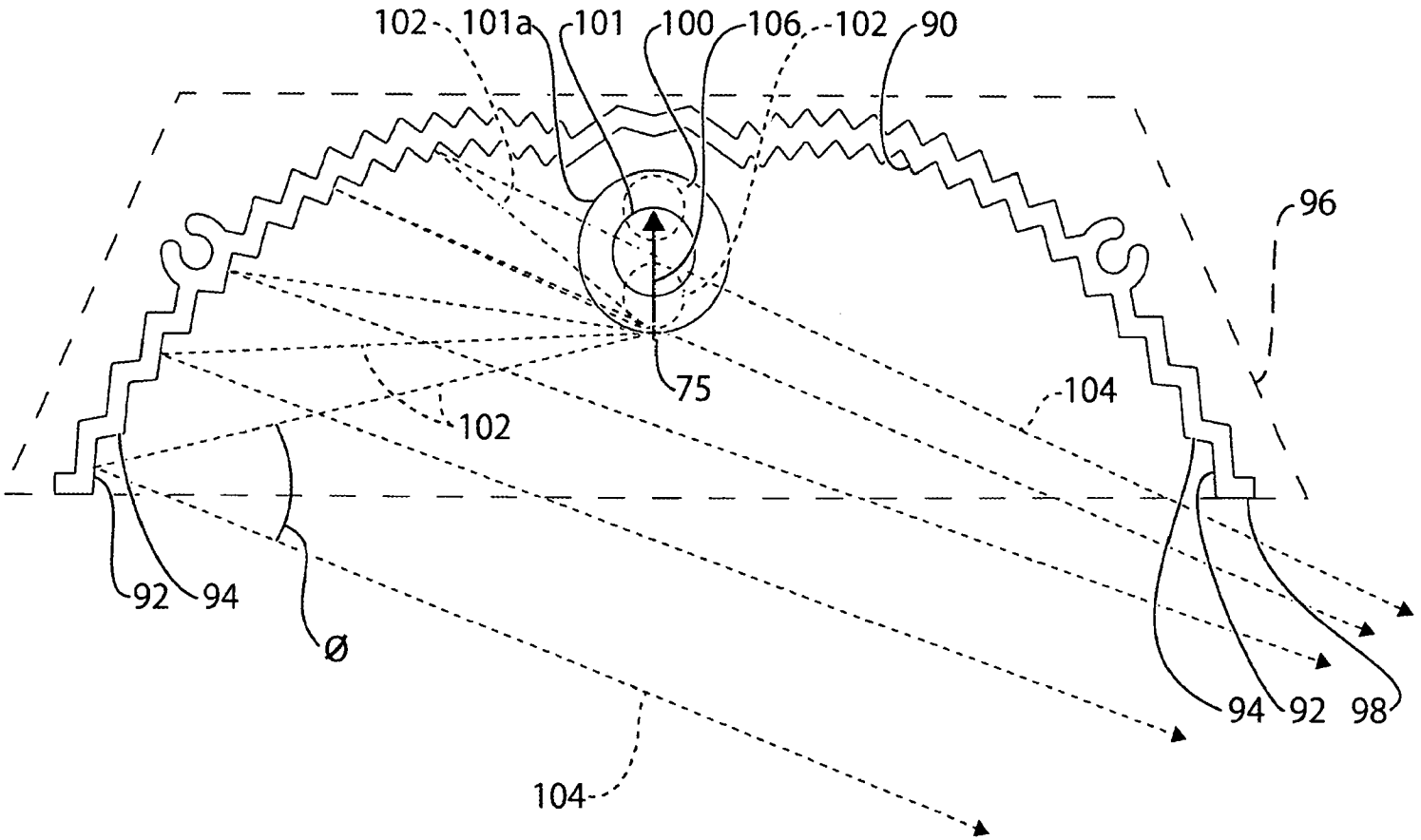
FIG. 16 is a schematic view of another device.

As schematically shown in FIG. 16, a far field light reflector portion 90 may be then be formed based on the modeled reflector profile 74 to provide a plurality of reflector path segments 92 coextensive with the modeled path segments and a plurality of reflector line segments 94 coextensive with the modeled line segments. The far field light reflector portion 90 may then be placed in or integrated with a housing structure shown schematically in dashed lines at 96, wherein the housing structure and/or the far field light reflector portion provide an outer periphery 98.

One light source 100, or more than one light source shown schematically at 102, may then be located in the offset position beside the focal point and/or between the focal point and the far field light reflector 90. It will be understood that a fixture employing the reflector portion 90 may be considered a linear far field lighting fixture, since the segments are elongate and are configured to the focal point which in the case of a linear fixture is in fact a focal line. However, the concepts may also be applied to a non-linear light fixture, such as a radially oriented light fixture, in which case the focal point does apply both in cross-section and in perspective. The light source 100 has a light emanating surface forming a light source boundary or perimeter 101. In this case, the light source is a high intensity discharge lamp with an inner frosted envelope defining the light source boundary and an outer transparent envelope 101*a*. In this case, the light source boundary 101 is spaced from the focal point. In other cases, the light source may be a fluorescent or incandescent lamp with a frosted outer light emanating surface defining a light source boundary 101*a*. Alternatively, the lamp may be a halogen or incandescent light with a transparent envelope around the lamp filament. In this instance, the light source boundary would be chosen between the filament and the transparent envelope.

The light source 100, the focal point 75 and the far field reflector 90 may then be configured to confine the incident light, shown at paths 102, from the light source boundary 101 to land on the reflector path segments 92, with the light source 100 so positioned to minimize, if not prevent, incident light from the light source landing directly on the reflector line segments 94. This of course takes into account the possibility that light from the reflective path segments 92 may in some cases be indirectly reflected off other parts of the fixture, such as external parts of the casing shown in FIG. 1*a*. It will be understood that, in some cases, one or more of the features of the external casing shown in FIG. 1*a* may not be needed for the range of lighting fixtures contemplated herein. For instance, external light hoods may constrain some far field lighting fixtures, for instance. This is provided by the placement of the focal point relative to the light source. The focal point, in this instance, is immediately beside the light source boundary. For the purposes of the illustration, the focal point is shown precisely on the light source boundary. An aim is to minimize direct incident light from the light source boundary on the reflector line segments. The greater the distance from the light source boundary, the greater the barrier to direct incident light on the reflector lines.

Each reflector path segment 94, in this example, also provide an angle of reflectance, theta, which is sufficient for substantially all light reflected from the far field light reflector to pass beyond the outer periphery 98 without being incident thereon.

Figure 17:
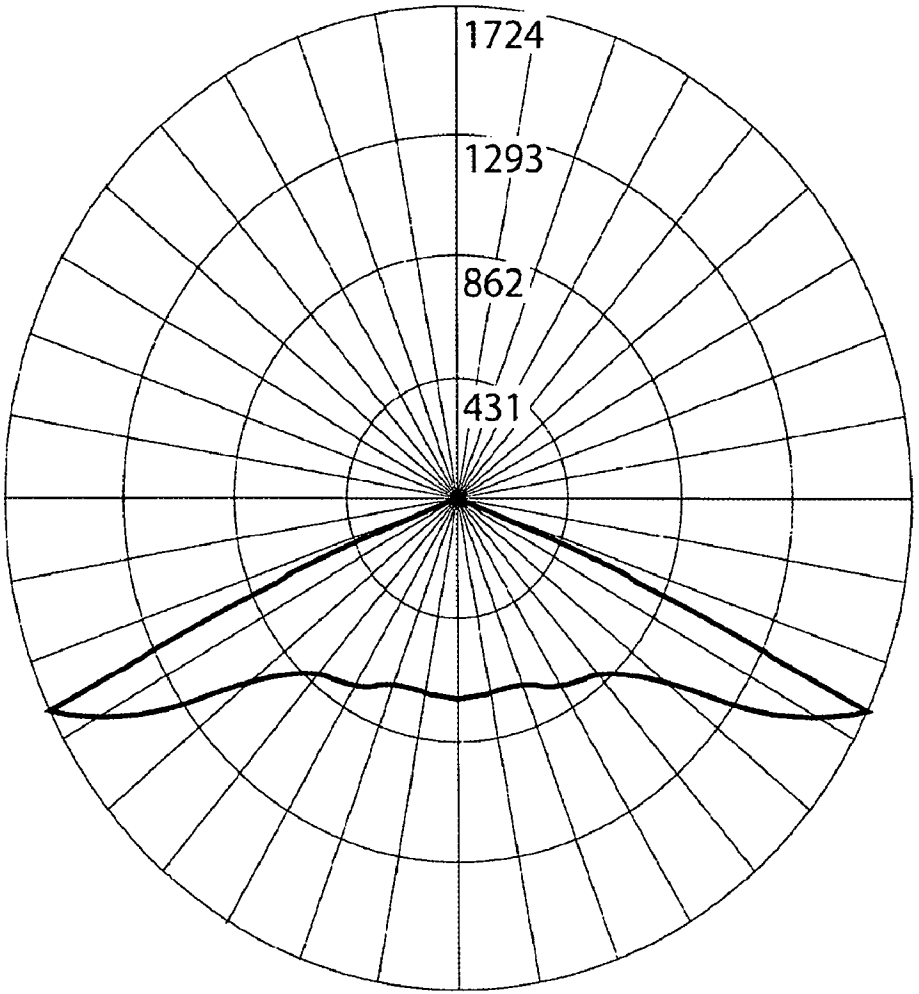
FIG. 17 is a candle power plot for the device of FIG. 16.

A candle power plot for the fixture of FIG. 16 is shown in FIG. 17, showing a distribution of light leaving the fixture with a relatively greater intensity at the lateral boundaries to accommodate the spread of the light beam toward the target surface.

Figure 1A:
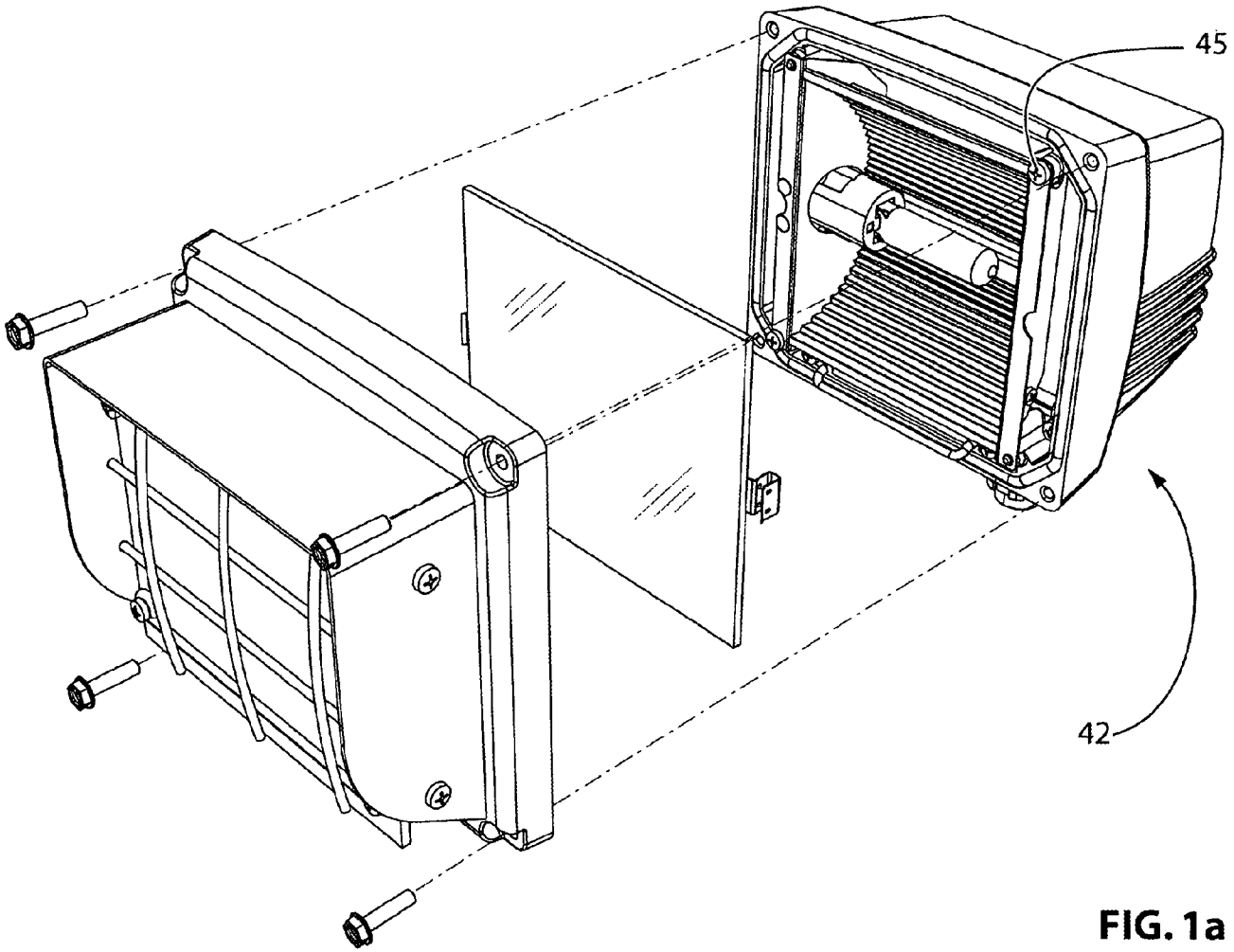
FIG. 1*a* is an assembly view of the light fixture including the device of FIG. 1.
Figure 2:
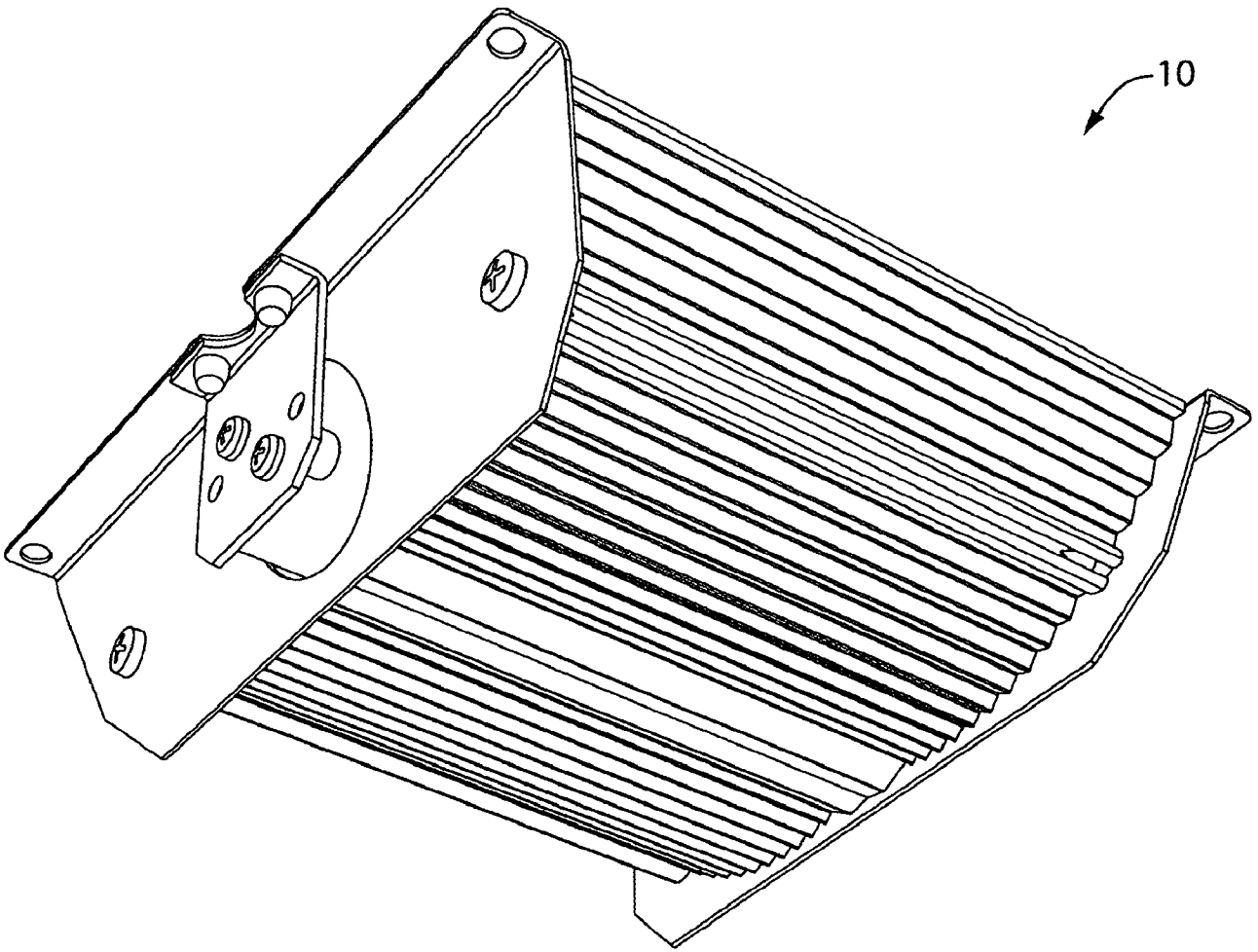
FIGS. 2 and 3 are perspective and assembly vies of the device of FIG. 1.

Thus, FIG. 16 shows a far field light reflector portion 90 which is coupled with the housing portions as shown in FIG. 1, so that the housing portions and/or the far field light reflector define an inner region and cooperating to form an outer fixture periphery.

In this case, the light source 100 is a high intensity discharge lamp which includes metal halide, high pressure sodium, and mercury vapor, as examples thereof, with an inner frosted envelope and an outer transparent envelope 101. In this case, the light source boundary is the inner frosted envelope shown at 101. In other cases, the light source may be a fluorescent or incandescent lamp with a frosted outer light emanating surface meaning that the outer envelope 101*a* would thus define a light source boundary. Alternatively, the lamp may be a halogen or incandescent light with a transparent envelope around the lamp filament. In this instance, the light source boundary would be a region between the filament and the transparent envelope. In this case, the transparent envelope 101*a* may extend beyond the focal point 75 provided the light source boundary remains at or above the focal point as shown in FIG. 16. The far field light reflector portion 90 has its focal point 75 located within the inner region of the housing structure. It can be seen that the focal point 75 faces the far field reflector portion in a first inward direction shown by the arrow 106. The lamp 100 is so arranged that the light source boundary 101 is offset in the inward direction 106 from the focal point 75 so that the lamp 100 is located between the focal point 75 and the reflector portion 90.

Figure 14:
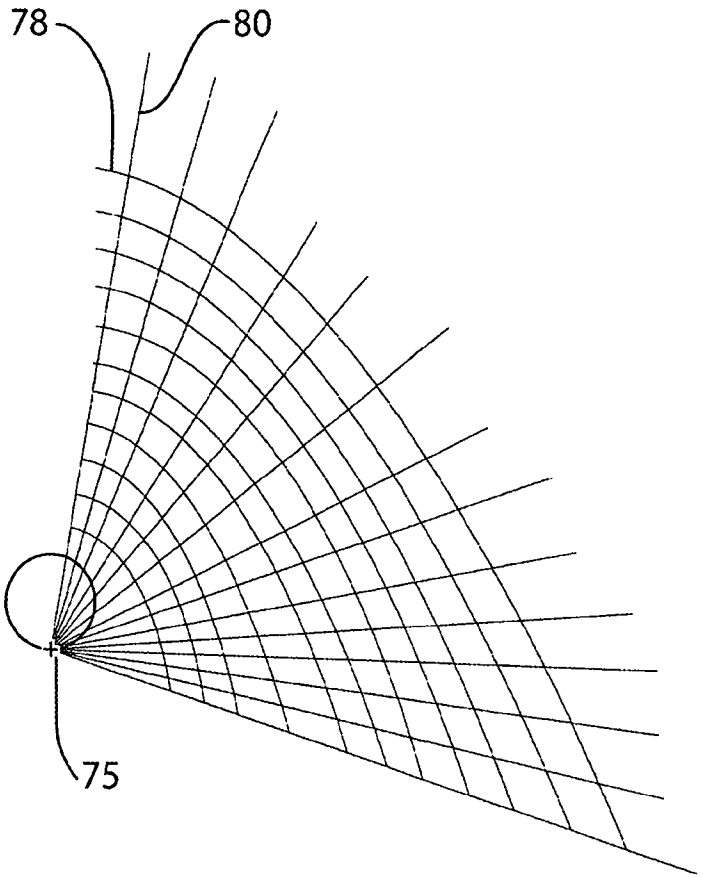

The reflector portion path segments 92 thus provide a plurality of reflector segments, each to receive incident light from the light source boundary 101. The reflector line segments 94 thus provide a plurality of radial segments, each of which separates a pair of neighboring reflector segments 92. Further, each radial segment 94 is co-linear with a radial line 80 extending from the focal point 75 (as shown in FIG. 14). It can be seen that each radial segment 94 faces away from the light source boundary 101.

Each reflector segment 92 is positioned relative to the focal point 75 to receive incident light from the light source boundary 101. Each reflector segment 92 is opposite a corresponding region on the outer boundary 98. Each reflector segment is thus arranged to emit reflected light at the angle of reflectance, theta, sufficient to direct the reflected light past the outer periphery 98 without being incident thereon.

In this example, as in FIG. 1, the light source boundary is the shape of an elongate cylinder with an elongate axis colinear with the focal point 75, the reflector segments being planar and parallel to the elongate axis.

Figure 15:
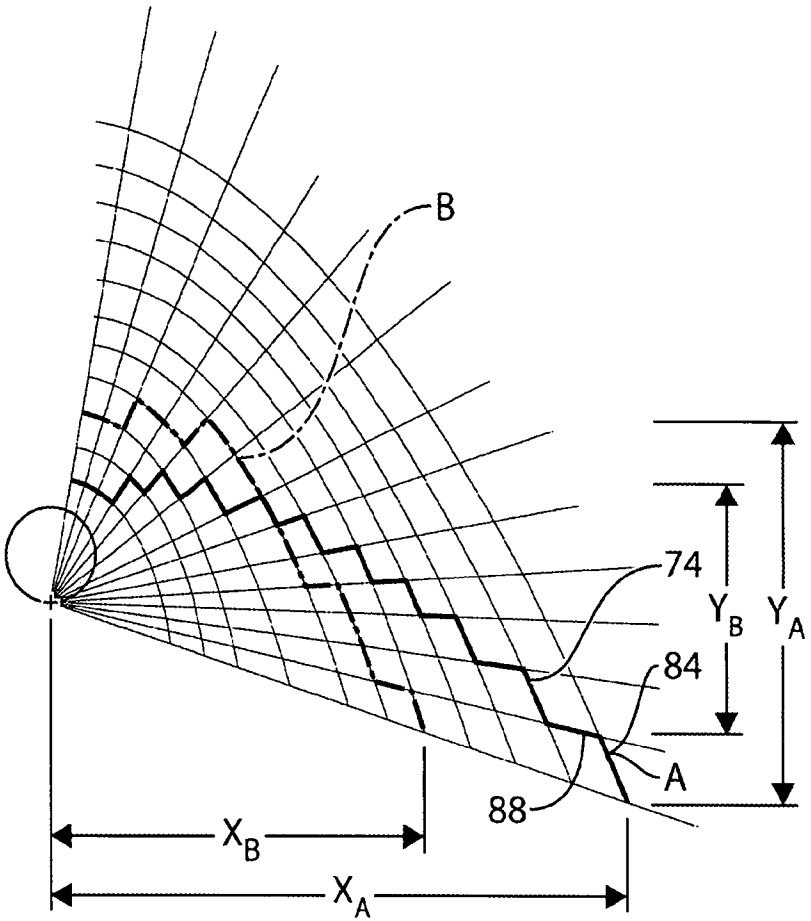
FIGS. 14 and 15 are views relating to a variation on the method of FIGS. 9 to 13.

The reflector portion is thus formed from the method described with respect to FIGS. 14 and 15. In this case, each of the reflector segments is coextensive with one of a corresponding plurality of modeled curvilinear reference paths scaled about the focal point. In this particular example, the curvilinear reference paths are parabolic curves, though they could be provided in other formations such as partial parabolic curves, circular curves, or partial circular curves or curvilinear paths which are partially curved and partially straight.

Thus, the example shown schematically in FIG. 16 provides a reflector portion and housing structure for fixture with far field optics to illuminate a targeted flat surface with substantially even illumination, such as a sign with relatively close positioning of the fixture to the targeted surface. In some cases, the fixture may reduce the number of fixtures needed and to reduce, if not eliminate, unwanted bright spots or dark spots on the targeted surface. In some cases, the fixture may substantially reduce the distance between the fixture and the targeted surface to ease mounting requirements, by the use of holding arms extending from a wall which can also be a target surface for facade lighting. The fixture thus provides wide angle light distribution to provide the even far field illumination on the target surface. The far field reflector portion in this example provides light directed to out each side with a wide angle light rays relative to the normal of the face of the fixture.

It can thus be seen in the example of FIG. 14 that the reflector is designed as a stepped segmented profile providing the desired distribution. In this case, reflector is formed based on a continuous parabolic reference curve with the a focal point below the light source as viewed in FIG. 14 and which is configured to reflect light rays out at a substantially continuous high angle and within the reflector opening and to minimize, if not prevent, multiple light reflections. A number of parabolic curves are then copied from the reference curve and scaled about the focal point. Concentric radial lines are drawn emanating from the focal point at constant angle and a reflector profile may then be sketched by tracing the parabolic curves and radial lines alternating in a step fashion to fit within a desired thickness. With the reflector so formed, one or more lamps may then be positioned between the focal point and the reflector where the focal point is situated outside light emanating surfaces of the lamp(s). With this arrangement, theoretically, no primary light coming from light emanating surfaces of the lamp fall on the segments of the reflector traced along the radial lines, thereby minimizing, if not eliminating, unwanted stray light. Further, all primary light coming from light emanating surfaces of the lamp falls on controlling parabolic traced segments of the reflector. In the example of FIG. 16, secondary light with one reflection from the reflector will pass across the central symmetrical line of the reflector, and exit the fixture with a second reflection, resulting in this case in a high efficiency wide light distribution fixture meeting the requirements of providing an even illumination on a flat target surface in the far field.

Thus, in one example, a traditional reflector shape may be formed, in this case a reflector with wide distribution. Multiple shapes, each at a scale of the original shape centralized to the centre of the focal region. A set of lines may then be created, each emanating from the below the lowest section of the lamp, or other light source, and spaced every 5 degrees in an angular rotation. A new reflector shape may then be formed by stepping by alternating trace between the scaled reflector profiles and lines of constant angular spacing. An opposing reflector shape may then be mirrored about a vertical line passing through the lamp or focal centre, or alternatively be shaped in different manner, such as by providing a flat reflective surface as shown at 88 in FIG. 5 for the light device 70. In this case, the resulting design surface may be extruded or spun to make a three dimensional form, in one example to perform as a low profile reflector. In other examples, the connector portion(s) may be formed separately from the reflector portion.

The device is particularly useful for lighting devices which need a "low profile" or shallow dimensions which would otherwise not be achievable while providing a wide light distribution. That being said, one or more features of the lighting devices and methods disclosed herein may be applied to applications which are not necessarily "low profile". The examples of the device and method herein may be applied to far field or wide angle flood or area lights mounted on walls, poles or the light, both for external and internal illumination, as well as to linear fixtures for interior office lighting and/or indoor industrial, commercial lighting for instance.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A far field lighting fixture, comprising one or more housing portions, a concave far field light reflector portion coupled with the housing portions, the housing portions and/or the far field light reflector defining an inner region and cooperating to form an outer fixture periphery, a lamp with a light emanating surface defining a light source boundary, the far field light reflector portion having a reference point located within the inner region, the lamp being arranged so that the light source boundary is in an offset position between the reference point and the reflector portion, the reflector portion including a plurality of reflector segments, each to receive incident light from the light source boundary, a plurality of radial segments, each separating a pair of neighboring reflector segments, each radial segment being co-linear with a radial path extending from the reference point, each radial segment facing away from the light source boundary, each reflector segment portion being positioned relative to a focal point to receive incident light from the light source boundary, each reflector segment being opposite a corresponding region on the outer boundary, each reflector segment to emit reflected light at an angle of reflectance sufficient to direct the reflected light past the outer periphery without being incident thereon.

2. A fixture as defined in claim 1, the reference point and the focal point being coincident.

3. A fixture as defined in claim 1, the focal point being between the reference point and the reflective portion.

4. A fixture as defined in claim 1, the light source boundary being in the shape of an elongate cylinder with an elongate axis, the reflector segments being planar and parallel to the elongate axis.

5. A fixture as defined in claim 4, each of the reflector segments being coextensive with one of a corresponding plurality of modeled curvilinear reference paths scaled about the focal point.

6. A fixture as defined in claim 4, each of the reflector segments being coextensive with one of a corresponding plurality of modeled parabolic reference paths scaled about the focal point.

7. A fixture as defined in claim 4, the far field reflector portion formed from an extruded section.

8. A fixture as defined in claim 4, the reflector portion including a pair of lateral sections symmetrically extending outwardly from the focal point.

9. A method of forming a far field lighting fixture, comprising the steps of:

establishing a focal point;

providing a concave primary reference path positioned relative to the focal point;

configuring the reference path and the position of the focal point to form a theoretical reflector profile for a far field lighting fixture with a light source to be located in an offset position between the focal point and the reference path;

providing a plurality of secondary reference paths which are concentric with the primary reference path and scaled about the focal point;

providing a plurality of radial lines extending from the focal point, each radial line meeting each primary and secondary reference path to form a plurality of path segments, each between adjacent radial lines, and to form a plurality of line segments, each between adjacent path segments;

forming a modeled reflector profile for a far field lighting fixture by forming a chain of adjacent groups of one or more path segments, joined by groups of one or more line segments;

forming a far field light reflector based on the modeled reflector profile to provide a plurality of reflector path segments coextensive with the modeled path segments and a plurality of reflector line segments coextensive with the modeled line segments;

locating the far field light reflector in a housing structure, the housing structure and/or the far field light reflector providing an outer periphery;

locating the light source in the offset position beside the focal point and between the focal point and the far field light reflector; and, configuring the light source, the focal point and/or the far field reflector to confine the incident light emanating surfaces of the light source to land on the reflector path segments, with the light source so positioned to minimize incident light from the light source on the reflector line segments, and with each reflector path segment providing an angle of reflectance which is sufficient for substantially all light reflected from the far field light reflector to pass beyond the outer periphery without being incident thereon.

10. A method of forming a reflector portion for a far field lighting fixture, comprising the steps of:

establishing a focal point;

providing a concave primary reference path positioned relative to the focal point;

configuring the reference path and the position of the focal point to form a theoretical reflector profile for a far field lighting fixture with a light source to be located in an offset position between the focal point and the reference path;

providing a plurality of secondary reference paths which are concentric with the primary reference path and scaled about the focal point;

providing a plurality of radial lines extending from the focal point, each radial line meeting each primary and secondary reference path to form a plurality of path segments, each between adjacent radial lines, and to form a plurality of line segments, each between adjacent path segments;

forming a modeled reflector profile for a far field lighting fixture by forming a chain of adjacent groups of one or more path segments, joined by groups of one or more line segments;

forming a far field light reflector based on the modeled reflector profile to provide a plurality of reflector path segments coextensive with the modeled path segments and a plurality of reflector line segments coextensive with the modeled line segments; and, locating the far field light reflector in a housing structure, the housing structure and/or the far field light reflector providing an outer periphery.

11. A method of forming a far field lighting fixture, comprising the steps of:

establishing a focal point;

establishing a reference point;

providing a concave primary reference path positioned relative to the focal point;

configuring the reference path and the position of the focal point to form a theoretical reflector profile for a far field lighting fixture with a light source to be located in an offset position between the reference point and the reference path;

providing a plurality of secondary reference paths which are concentric with the primary reference path and scaled about the focal point;

providing a plurality of radial lines extending from the reference point, each radial line meeting each primary and secondary reference path to form a plurality of path segments, each between adjacent radial lines, and to form a plurality of line segments, each between adjacent path segments;

forming a modeled reflector profile for a far field lighting fixture by forming a chain of adjacent groups of one or more path segments, joined by groups of one or more line segments;

forming a far field light reflector based on the modeled reflector profile to provide a plurality of reflector path segments coextensive with the modeled path segments and a plurality of reflector line segments coextensive with the modeled line segments;

locating the far field light reflector in a housing structure, the housing structure and/or the far field light reflector providing an outer periphery;

locating the light source in the offset position beside the reference point and between the reference point and the far field light reflector; and, configuring the light source, the focal point, the reference point and/or the far field reflector to confine the incident light emanating surfaces of the light source to land on the reflector path segments, with the light source so positioned to minimize incident light from the light source on the reflector line segments, and with each reflector path segment providing an angle of reflectance which is sufficient for substantially all light reflected from the far field light reflector to pass beyond the outer periphery without being incident thereon.

* * * * *